US007827896B2

(12) United States Patent
Hektoen et al.

(10) Patent No.: US 7,827,896 B2
(45) Date of Patent: Nov. 9, 2010

(54) FIREARM REMOTE COCKING METHOD AND ARRANGEMENT

(75) Inventors: Jan Marius Hektoen, Borgheim (NO); Lars Harald Henriksen, Skallestad (NO)

(73) Assignee: Kongsberg Defence & Aerospace AS, Kongsberg (NO)

( * ) Notice: Subject to any disclaimer, the term of this patent is extended or adjusted under 35 U.S.C. 154(b) by 730 days.

(21) Appl. No.: 11/785,816

(22) Filed: Apr. 20, 2007

(65) Prior Publication Data

US 2010/0251880 A1 Oct. 7, 2010

(51) Int. Cl.
*F41A 7/00* (2006.01)

(52) U.S. Cl. ..... 89/1.4; 89/154

(58) Field of Classification Search ..... 89/1.42, 89/1.4, 154; D8/360
See application file for complete search history.

(56) References Cited

U.S. PATENT DOCUMENTS 2,071,020 A * 2/1937 Boussel ..... 89/1.4
2,168,114 A * 8/1939 Boussel ..... 89/127
2,232,631 A 2/1941 Renick
2,332,631 A * 10/1943 Gasser ..... 89/1.4
2,384,834 A * 9/1945 Grant, Jr. et al. ..... 89/1.4
2,384,887 A * 9/1945 Brunner et al. ..... 89/1.4
2,386,801 A * 10/1945 Johnson et al. ..... 89/1.4
2,389,737 A * 11/1945 Neuschotz ..... 74/506
2,397,507 A * 4/1946 Roberts, Jr. ..... 74/89.2
2,431,079 A 11/1947 Richey
2,576,015 A * 11/1951 Humphrey ..... 89/1.4
2,717,532 A * 9/1955 Ramseyer ..... 89/1.4
2,789,466 A * 4/1957 Summers ..... 89/1.4
2,810,325 A 10/1957 Deslierres et al.
2,845,001 A * 7/1958 Hillberg ..... 89/1.4
2,998,753 A * 9/1961 Knaub et al. ..... 89/1.815
3,044,361 A * 7/1962 Lizza ..... 89/1.4
3,410,171 A * 11/1968 Bremer ..... 89/1.4
4,261,247 A * 4/1981 Reynolds ..... 89/44.01
4,383,471 A * 5/1983 La Fever ..... 89/1.4

FOREIGN PATENT DOCUMENTS

DE 675861 5/1939

* cited by examiner

*Primary Examiner*—Benjamin P Lee
(74) *Attorney, Agent, or Firm*—Young & Thompson

(57) ABSTRACT

A remote cocking and charging device for a weapon on a mount, the weapon having a bore axis and a rope actuated cocking and charging mechanism having a rope end exiting from the weapon. The device includes a first rotatable pulley having an axis of rotation fixedly connected to the mount and positioned adjacent to and below an exit point of the rope from the weapon positioned in the mount, a second rotatable pulley having an axis of rotation fixedly connected to the weapon mount and positioned below and spaced from the first pulley, and a linearly moveable actuator arm having a longitudinal axis situated substantially in a plane and substantially parallel to the bore axis, the actuator arm at an end thereof including a rope engagement element.

18 Claims, 5 Drawing Sheets

FIREARM REMOTE COCKING METHOD AND ARRANGEMENT

BACKGROUND OF THE INVENTION

1. Field of the Invention

The invention relates to a remote cocking and charging mechanism for the GDATP MK47 (Striker40) Advanced Lightweight Grenade Weapon System.

2. Description of the Related Art

The cocking and charging mechanism for the MK47 (STRIKER40) distinguishes itself from other weapon systems. The cocking and charging mechanism is installed on the right hand side of the weapon, and cocking and charging is done by manually pulling the charge handle backwards and away from the weapon, which handle in turn pulls a rope that operates a mechanism which charges the weapon. The total charge pull for the MK47 is approximately 25 kg, which corresponds to a pull force of about 50N. Other weapons usually have a cocking mechanism that consists of a bolt moving in the longitudinal direction.

The remote weapon station (RWS) known as Protector M151, a product of Kongsberg Protech AS of Norway, is a remotely operated weapons platform equipped with a TV camera or other imaging device, which allows an operator to aim at a target a weapon attached to the RWS while the operator is in a remote location away from the weapon, protected from possible threats in the surroundings that are open with respect to RWS. The Protector M151 RWS includes a remotely operated cocking and charging device, which device is designed for cocking and charging a type of weapon having a cocking and charging mechanism on the left hand side of the weapon, such as the mechanism mentioned above having of a bolt moving in the longitudinal direction. Accordingly, the already existing remote controlled cocking and charging mechanisms of the Protector M151 RWS cannot be employed for cocking and charging mechanism the MK47 (STRIKER40).

Rope pull charging and cocking mechanisms are disclosed in U.S. Pat. No. 2,386,801, U.S. Pat. No. 2,789,466, and U.S. Pat. No. 2,845,001.

A combined manual and remote, rope pull based charging and cocking device for a weapon having a bolt moving in the longitudinal direction is disclosed in WO/2006/056991.

In order to perform the manual operations required to do the cocking and charging of the MK47 when mounted to the Protector M151 RWS in its present build, the operator must be located in open space immediately adjacent to the weapon, thereby exposing himself for possible threats form the surroundings. There is a need for remote cocking and charging means adapted to allow remote cocking and charging of the MK47 (STRIKER40) weapon mounted on the Protector M151 RWS, without requiring the presence of a human operator in the open space immediately at the MK47 weapon.

SUMMARY OF THE INVENTION

The present invention provides a device for remotely cocking and charging a weapon having weapon having a bore axis and a rope actuated cocking and charging mechanism having a rope end exiting from the weapon, the features of which device are recited in the accompanying patent claims, and varieties thereof as taught by the following disclosure.

BRIEF DESCRIPTION OF THE DRAWING FIGURES

In the following, the remote cocking and charging device of the invention will be described by way of example and by using the same reference designations for the same elements throughout, and with reference to the accompanying drawings, wherein.

Figure 1:
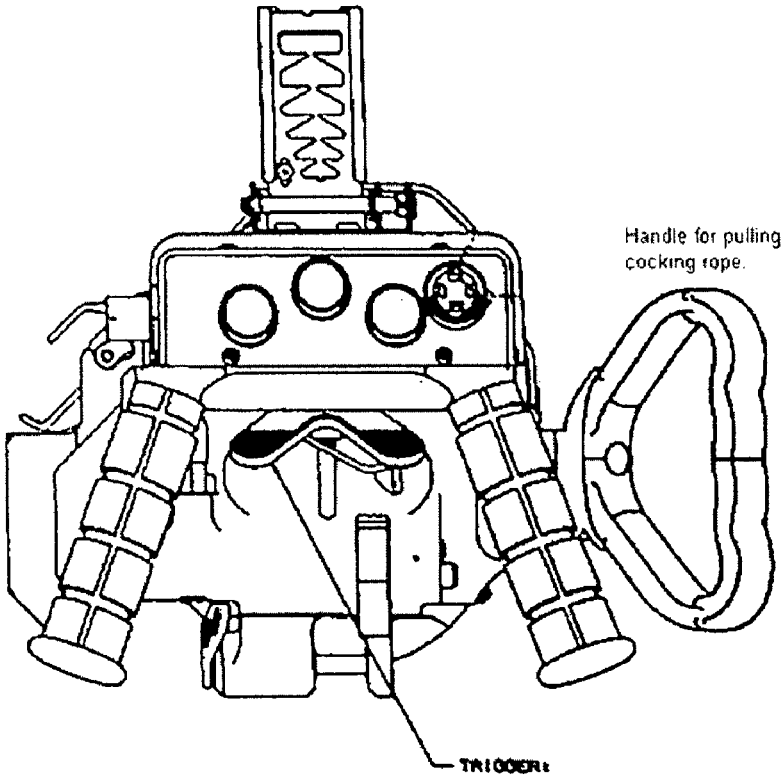
FIG. 1 is a rear view drawing of the MK47 weapon.
Figure 3:
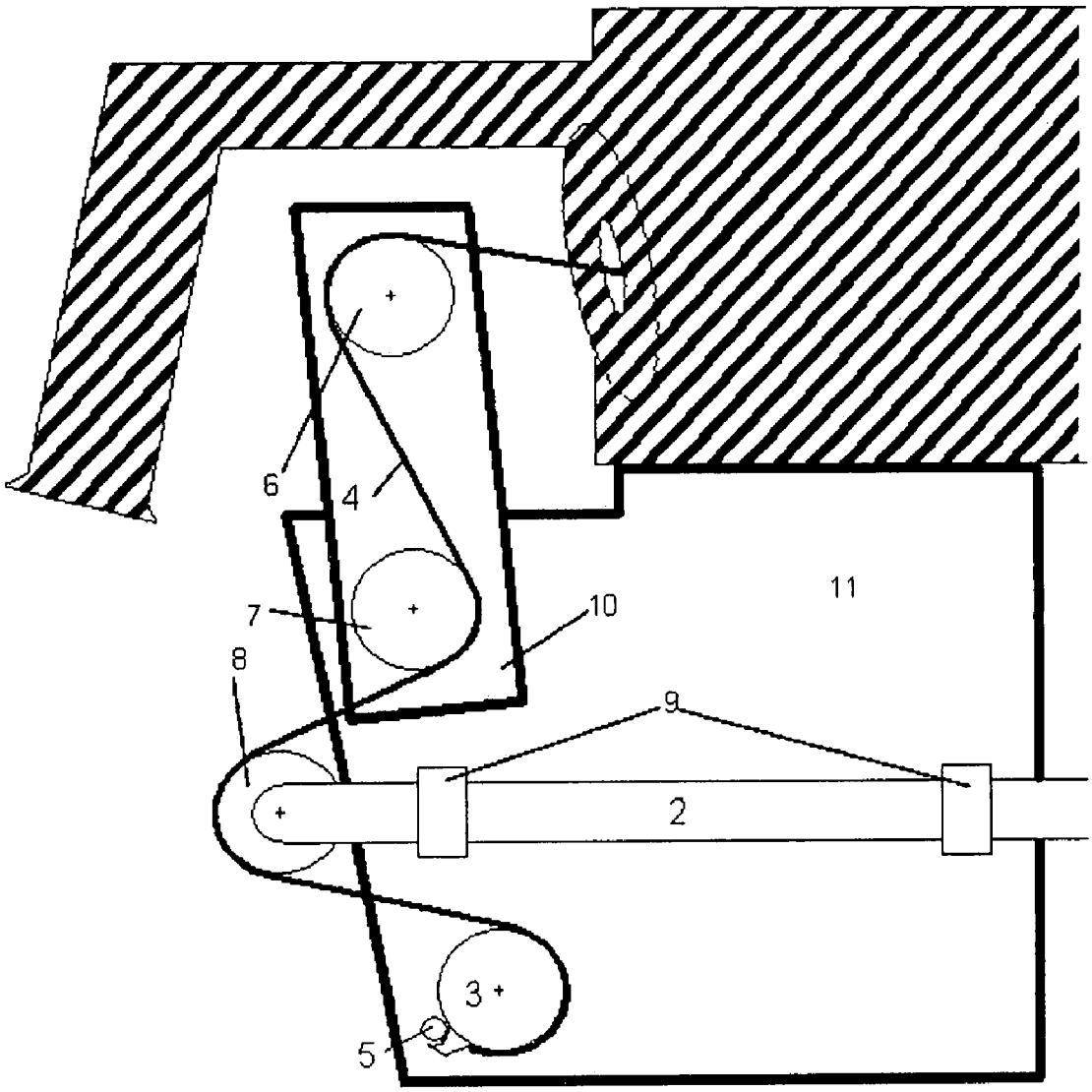
Figure 4:
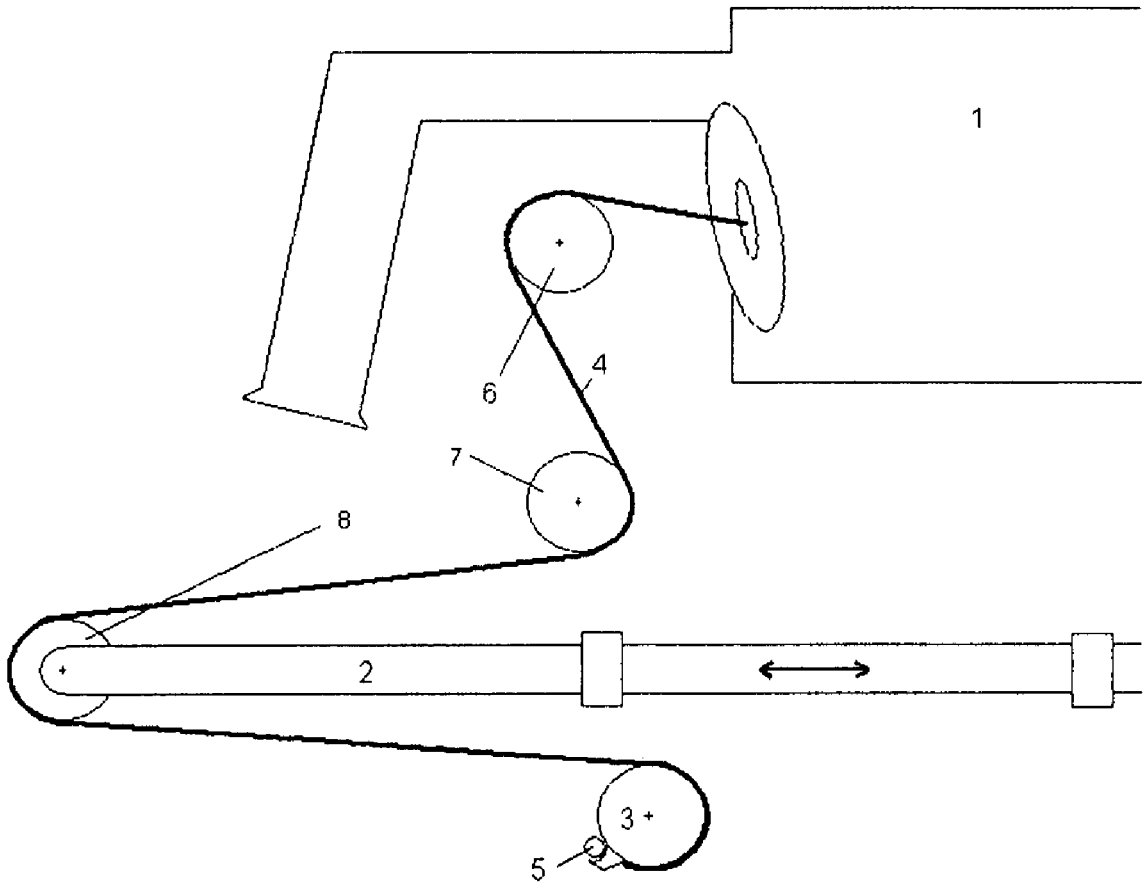
Figure 5:
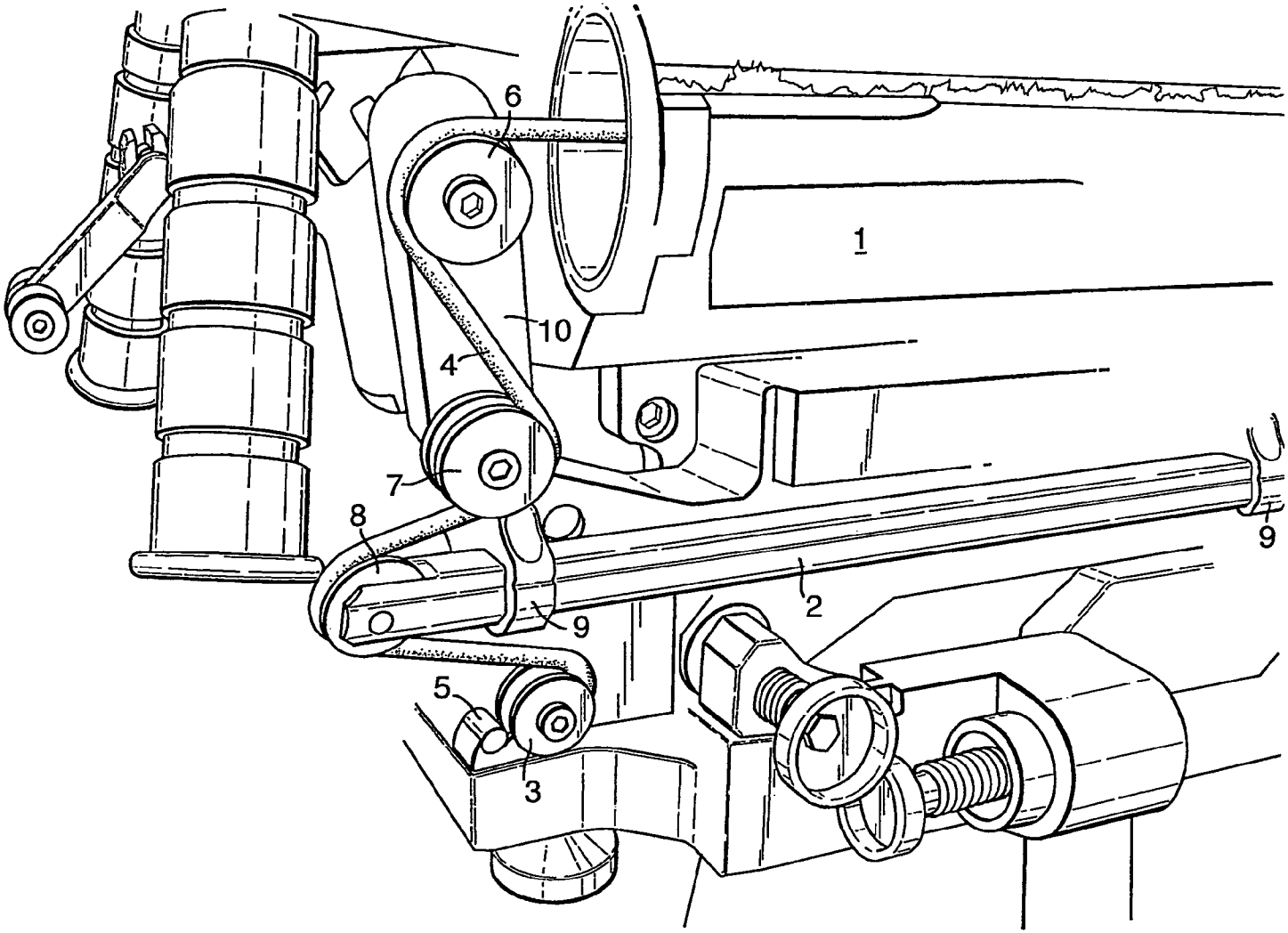
Figure 6:
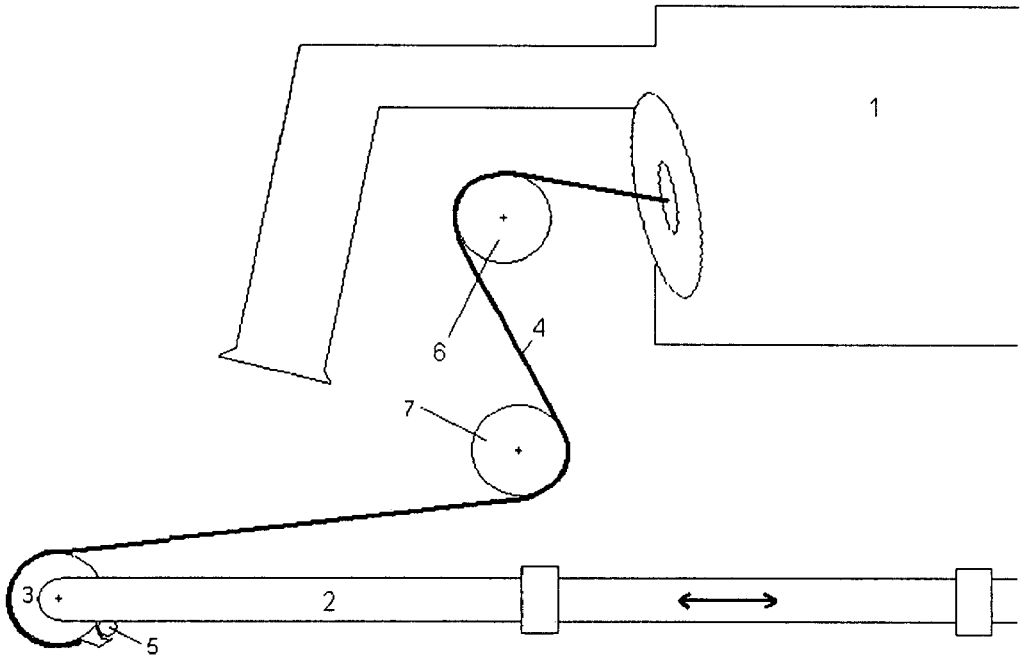
Figure 7:
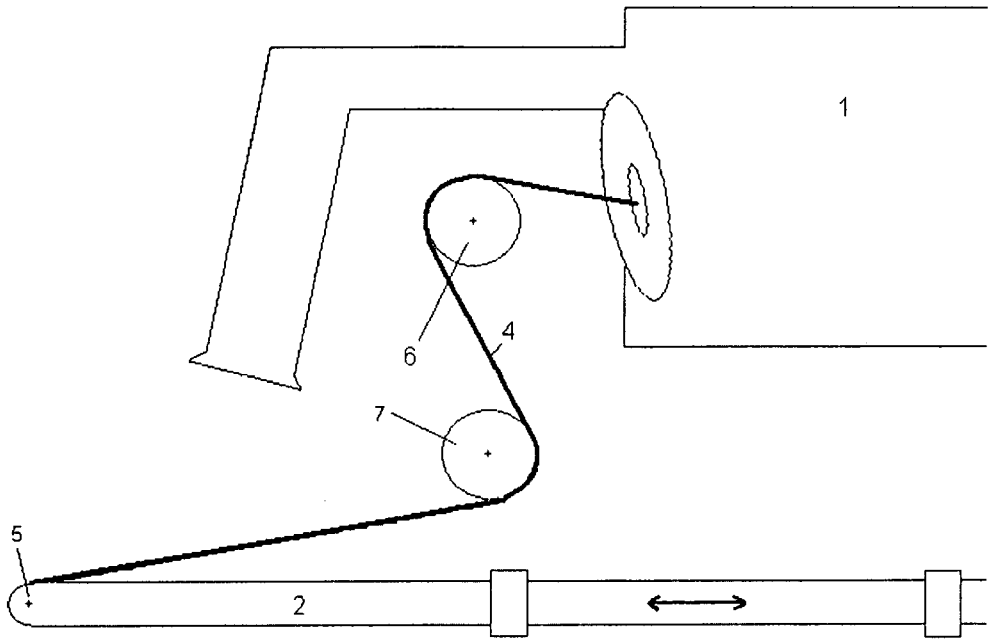

FIG. 3 is a schematic side view illustration of an embodiment of a cocking and charging device according to the invention in a first state, FIG. 4 is a schematic side view illustration of the embodiment of a cocking and charging device according to the invention shown in FIG. 1, shown in a second state, FIG. 5 is a photographic perspective view of a realisation of the embodiment of the cocking and charging device according to the invention illustrated schematically in FIGS. 3 and 4, shown in the first state, and including the MK47 weapon mounted on the Protector M151 RWS, FIG. 6 is a schematic side view illustration of another embodiment of a cocking and charging device according to the invention, also shown in the first state, and FIG. 7 is a schematic side view illustration of yet another embodiment of a cocking and charging device according to the invention, also shown in the first state.

DETAILED DESCRIPTION

Figure 2:
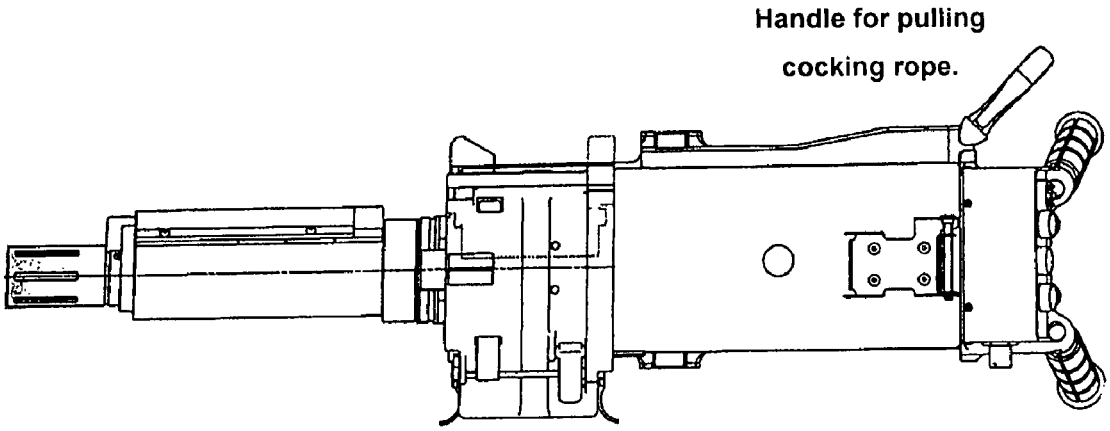
FIG. 2 is a top view drawing of the MK47 weapon.

For explaining the present invention, examples based on embodiments adapted for the MK47 weapon are employed. The MK47 weapon, illustrated in FIGS. 1 and 2, is known equipped with a manual cocking and charging mechanism which includes a rope attached to a handle that must be pulled back to a predetermined extent in order to complete the cocking and charging of the MK47 weapon. The rope has a length adapted such that the rope becomes fully retracted into the casing of the weapon when no pull force is applied to the handle. The state of the cocking and charging mechanism of the MK47 weapon when no pull force is applied to the handle is referred to herein as the first state.

The invention is illustrated by the accompanying schematic drawings 3, 4, 6, 7 and 8, all showing in a side view drawing charging devices of the invention, and parts of the weapon and its accessories. The mount part of the remote weapon station (RWS) is generally not displayed in any of the accompanying figures. To facilitate a better understanding of the invention, in FIG. 3, however, is shown a mount adapter 11 typically being employed to provide an interface to the attachment means of the weapon as well as to the attachment means of the RWS, a bracket 10 is identifiable, and the weapon 1 has been provided with a hatched appearance in order for it to be clearly identified.

With reference to FIGS. 3, 5, 6 and 7, various cocking and charging devices implementing various features of the invention are illustrated in the first state, as defined above. That is, the first state corresponds to the state in which the weapon adapted for manual cocking and charging illustrated in FIGS. 1 and 2 is shown, in which first state the cocking and charging has not been started or has been fully completed, and in which state no substantial pull force is applied to the rope of the cocking and charging mechanism of the weapon.

Referring to FIGS. 3 and 4, a first embodiment of the cocking and charging device according to the invention comprises a set of first and second pulleys 6, 7 rotatably mounted advantageously to a bracket 10 shown in FIG. 3 only, an elongated linear actuator arm 2 being slideable in a longitudinal direction and having a third pulley 8 rotatably attached to a free end, a rope, string or wire 4, and retainer 3,5 for holding stationary an outer end of the rope 4. The bracket 10 is advantageously stationary with respect to, and attached to or forms part of, a mount adapter 11. In other embodiments than those referred to herein for explaining the present invention, it is envisioned that the bracket 10 be attached to or forms part of the RWS, or event the weapon itself. The linear actuator arm 2 is advantageously slideably supported by way of supports 9, which supports are attached to the adapter 11, or, optionally, the RWS mount or the weapon, so as to remain stationary with respect to the actuator arm 2, advantageously also with respect to the MK47 weapon. Thus, the supports 9 allow the actuator arm 2 to move freely in its longitudinal direction, while generally restricting the arm 2 from moving in other directions. The direction of longitudinal movement of the actuator arm 2 is advantageously made to be substantially in parallel with a longitudinal axis of the weapon, or close to the direction in which the rope may be freely pulled from the weapon, for the purpose of keeping transversal pull or push force components transferred between the weapon 1 and the actuator arm 2 to a minimum. The rope, string or wire advantageously is selected to exhibit flexible properties that are similar to those of the rope provided with the weapon when adapted for manually cocking and charging the weapon. Upon emerging and extending from the rear end of the weapon 1, in a backwards direction relative to the weapon, the rope 4 is arranged to engage with an upper part of an outer surface of the first pulley 6 and extends to rest against the outer surface of the first pulley 6 for between about one fourth to about one third of its circumference. Next, the rope 4 extends from a rearwards facing part of the zo first pulley 6 in a mostly downwards direction to engage with a forward part of the outer surface of the second pulley 7, and extends to rest against the second pulley 7 for between about one fourth to about one third of its circumference. Next, the rope 4 extends from a downwards facing part of the second pulley 7, substantially in a backwards direction relative to the weapon, to engage with an upper part of an outer surface of the third pulley 8 situated at the rearwards free end of the actuator arm 2.

Extending from its point of engagement with upper part of the outer surface of the third pulley 8, the rope advantageously extends to rest against the outer surface of the third pulley 8 for between about one third to about one half of its circumference, depending on the longitudinal position of the actuator arm 2. Next, the rope 4 extends from a downwards facing part of the third pulley 8, substantially in a forwards direction relative to the weapon, to engage with an upper part of an outer surface of the fourth pulley 3 that is substantially stationary and provided with a rope end retainer means 5.

It should be noted that when the cocking and charging device is in the first state, it is not required for the rope to be in engagement with the third pulley 8, and that the rope may extend more or less directly from the second pulley 7 to the stationary pulley 8. In this case, the rope will be caught by the third pulley 8 by sufficient rearwards movement of the actuator arm 2. Furthermore, the fourth, stationary pulley 3 may be replaced by a simple, stationary means for anchoring the corresponding outer end of the rope 4 to the adapter 11, to the weapon 1, the RWS or other part that remain stationary with respect to the weapon and the actuator arm 2.

Reference is now made to FIG. 4, showing the illustrated embodiment of the cocking and charging device of the invention in the second state, in which second state a substantial pull force is applied to the rope by a substantial backwards linear movement of the actuator arm 2. An actuator control device is adapted to control the linear movement of the actuator arm 2, so as to ensure the application of the total charging pull and rope movement specified for the weapon, and to effect a return movement, in the forwards direction, of the actuator arm 2 to safely complete the weapon cocking and charging operation. The backwards and forwards directions of movement of the actuator arm 2 is illustrated in FIGS. 4, 6 and 7 by the double ended arrow.

According to the embodiment shown in FIGS. 3, 4 and 5, the extent of the rope being pulled from the weapon by the movement of the actuator arm 2 in the backwards direction advantageously is about two times the distance by which the actuator arm 2 is zo shifted. A further, additional advantage of the embodiment illustrated by FIGS. 3, 4 and 5, is the ability to minimise the risk of sticking of the actuator arm 2, obtainable by the possibility of positioning the second pulley 7 and fourth pulley 3 substantially symmetrical relative to the actuator arm 2, thereby substantially eliminating the occurrence force components transversal to the longitudinal direction of movement of the actuator arm 2. Similar advantages are also obtained, considering the forces being developed from firing rounds from the weapon.

Advantageously, the substantially stationary pulley 3 includes a ratchet device for its coupling to other stationary parts of the weapon system, such as for example the adapter 11. In the embodiments illustrated in FIGS. 3, 4, 5, and 6, the ratchet device would allow the pulley to be rotated in only one way, such that by rotating the pulley 3 the rope may be tightened to a obtain a suitable tensioning of the rope 4, so as to ensure that the rope may not disengage or be dislodged from the other pulleys. Thus, for the embodiments illustrated in FIGS. 3, 4 and 5, the ratchet device would allow rotation of the pulley only to be made in a clockwise direction, while for the embodiment illustrated in FIG. 6, the ratchet device would allow rotation of the pulley only to be made in a counterclockwise direction. Advantageously, the rope terminating retainer 5 constitutes a cylindrical bolt positioned at the rope end in a direction normal to a longitudinal axis of the rope, thus makes up the termination of the rope, which bolt 5 would be retained by a protruding feature on the lower fixed pulley 3.

Other alternative devices envisioned for providing a tensioning of the rope are (not illustrated) to provide spring loaded, shiftable axes of rotation of any of the pulleys, a tensionable spring device with limited travel connected between the rope 4 and the stationary part of the system at which the outer end of the rope 4 is to be terminated, and spring loaded pivoting arrangement of the bracket 10. For tensioning of the rope 4, the actuator arm 2 could be provided with some telescopic feature with limited travel which in conjunction with a spring providing a force in the longitudinal direction of the arm would maintain a certain tension of the rope 4 as long as the outer end of the actuator arm is in some way in engagement with the rope 4.

Second and third embodiments of the invention will now be explained with reference to FIGS. 6 and 7 of the accompanying drawings.

The embodiment of FIG. 6 is a variety of the embodiment of FIGS. 3, 4 and 5, wherein the rope end is terminated at the free end of the actuator arm by removal of the zo freely rotating third pulley 8 and replacing it by the stationary (i.e. non-rotating) fourth pulley 3. For locating the fourth pulley 3 having a ratchet device, as explained above, at the end of the actuator arm, it is in a "flipped" state, thus allowing a winding up of a free end of the rope, such as for providing for a tensioning of the rope 4.

The embodiment of FIG. 7 is a further variety of the embodiment of FIGS. 3, 4 and 5, and of FIG. 6, wherein the rope end is terminated directly at the free end of the actuator arm 2, thereby eliminating third and fourth pulleys 8 and 3, respectively.

In respect of the various embodiments mentioned herein to explain the present invention, an extended version of the rope of the weapon adapted for manual cocking and charging is employed, in the form of a suitable rope, string or wire 4, as explained above.

Advantageously, a suitable mechanical adapter is provided to allow a transfer of a drive force as provided by the existing actuator means of the Protector M151 RWS, to the actuator arm 2 of the cocking and charging device of the present invention. The required drive force, as well as the correct travel of the actuator arm 2, would be obtained by a suitably designed mechanical linking means, such as a guided cable or wire, an arrangement of guided and coupled struts or bars, or some other suitable linking arrangement, between the existing actuator means of the Protector M151 RWS and the actuator arm 2 of the cocking and charging device of the present invention.

It should be noted that the cocking and charging device of the present invention may be further developed to an embodiment (not illustrated) wherein the rope 4 is allowed to extend and run from the rearwards facing side of the first pulley 6 to the rearwards facing side of the second pulley 7, which in FIGS. 3 through 7 would be in an almost straight downwards direction, then extend forwards from a downwards facing part of the second pulley 7 to proceed to the end of the actuator arm 2, wherein the actuator arm 2 would be adapted to move linearly in a forwards direction relative to the position illustrated in FIG. 3. This would imply that the supports 9 would be located differently so as not to restrict the forwards movement of the actuator arm 2. Also, the third pulley 8 may be applied at the end of the actuator arm 2, with the rope running at against its forward facing side, and with the rope terminated at a stationary point as suggested earlier. The cocking and charging action would then effectively be performed by applying a force to the rope 4 by moving the actuator arm 2 in a direction opposite of what is the case of the embodiments explained above.

Remotely charging the weapon is done by remotely controlled operation of the linear actuator. The actuator, with a pulley at the end, will push backwards (left on the FIGS. 3 through 7) and put force on the rope. The rope will in turn, via the weapon's internals, pull the weapon's breech block backwards as the rope itself is pulled back by the actuator. By controlling the force and length of operation of the actuator, the breech block will be pulled fully backwards and retained in its rearward position by the trigger mechanism, just as it normally would if charged by hand via the rope and handle, or by recoil force by firing a live round. Retaining the breech block in its rearward position depends on the trigger not being pressed.

After a full stroke (back and forth) of the actuator, it will return to its start position, referred to as the first state. A spring loaded mechanism inside the weapon will recover the extracted rope automatically, preferably at a rate sufficient to keep the rope against the third pulley 8 on the end of the actuator at all times.

The cocking and charging device according to the invention allows for easy mounting of the weapon, as no tools are required to guide the rope over the pulleys and secure the rope's end bolt to the lower, fixed pulley.

The invention claimed is:

1. A device for operating from a remote place a rope actuated cocking and charging mechanism of a weapon (1) on a weapon mount (11), the weapon having a bore axis and the rope actuated cocking and charging mechanism having a rope emerging from a rope exit of the weapon, the weapon having an upwardly facing upper part and a downwardly facing lower part adjoining the weapon mount, the rope exit being positioned to one side of the weapon and between the upper part and the lower part, wherein the device comprises:

a first rotatable pulley (6) having an axis of rotation fixedly connected to a first part of the weapon mount and positioned adjacently to and below said rope exit of said weapon positioned in the weapon mount, a second rotatable pulley (7) having an axis of rotation fixedly connected to said first part of the weapon mount and positioned below and spaced from the first pulley, and a linearly moveable actuator arm (2) on support means (9) fixedly connected to the weapon mount and adapted to facilitate linear movement of the actuator arm, said actuator arm having a longitudinal axis being substantially parallel to said bore axis, said actuator arm at an end thereof comprising a rope engagement means, the actuator arm being moveable between a retracted position and an extended position, the first pulley, second pulley and actuator arm being arranged so as to allow said rope exiting from said weapon in the mount to extend from the rope exit and run, in sequence, to and over a part of a circumference of the first pulley, to and over a part of a circumference of the second pulley, and in a rope pulling force coupling engagement with said actuator arm end.

2. The device of claim 1, further comprising:

a third rotatable pulley (8) having an axis of rotation fixedly connected to the actuator arm end, and a rope end fixation means (3, 5) being fixedly connected to the weapon mount and being situated substantially in a plane wherein lies the longitudinal axis of the actuator arm and at an opposite side of the actuator arm with respect to the first and second pulleys, the third rotatable pulley (8) and the rope end fixation means being arranged so as to allow said rope exiting from said second pulley to extend and run to and over a part of a circumference of the third pulley to provide the rope pulling force coupling engagement with said actuator arm end, and to extend and run to the rope end fixation means.

3. The device of claim 2, wherein a first part of the circumference of the third pulley faces in a direction substantially opposite to a firing direction of the weapon.

4. The device of claim 2, wherein the rope end fixation means (3,5) comprises a fourth pulley or cylinder having a ratchet so as to allow non-return winding up of excess rope on said fourth pulley or cylinder, thereby providing a rope tensioning means.

5. The device of claim 2, wherein the first part of the circumference of the first pulley faces in a direction substantially opposite to the facing direction of first part of the circumference of the second pulley.

6. The device of claim 2, wherein the first part of the circumference of the third pulley faces in a direction substantially opposite to a firing direction of the weapon.

7. The device of claim 2, wherein the rope end fixation means (3,5) comprises a fourth pulley or cylinder having a ratchet so as to allow non-return winding up of excess rope on said fourth pulley or cylinder, thereby providing a rope tensioning means.

8. The device of claim 2, wherein the rope end fixation means (3,5) comprises a bolt (5) adapted to affix the rope end relative to the weapon.

9. The device of claim 2, wherein the first part of the weapon mount comprises a bracket (10).

10. The device of claim 2, wherein the weapon is a MK47 machine grenade gun.

11. The device of claim 2, further comprising a linkage adapted to transfer a force and movement provided by an existing actuator of a remote weapon station (RWS) to the actuator arm 2.

12. The device of claim 1, wherein a first part of the circumference of the first pulley faces in a direction substantially opposite to the facing direction of first part of the circumference of the second pulley.

13. The device of claim 1, wherein a rope end fixation means (3,5) comprises a bolt (5) adapted to affix the rope end relative to the weapon.

14. The device of claim 1, wherein a first part of the weapon mount is a bracket (10).

15. The device of claim 14, wherein the bracket (10) is moveably attached to the mount (11) by way of a spring loaded pivoting arrangement of the bracket, so as to provide a means for adjusting the position of at least one of the first and second pulleys, thereby providing a rope tensioning means.

16. The device of claim 1, wherein the weapon is a MK47 machine grenade gun.

17. The device of claim 1, further comprising a linking means arranged between the actuator arm and an actuator of a remote weapon station (RWS), to transfer a force and a movement provided by the actuator to the actuator arm 2.

18. The device of claim 17, wherein the remote weapon station is a Protector M151 RWS.

* * * * *